US008142151B2

(12) United States Patent
Zacharias

(10) Patent No.: US 8,142,151 B2
(45) Date of Patent: Mar. 27, 2012

(54) INTERMEDIATE HOUSING FLOOR FOR A FLUID KINETIC MACHINE

(75) Inventor: Wolfgang Zacharias, Duisburg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 13/060,880

(22) PCT Filed: Aug. 25, 2009

(86) PCT No.: PCT/EP2009/060922

§ 371 (c)(1),
(2), (4) Date: Feb. 25, 2011

(87) PCT Pub. No.: WO2010/026077

PCT Pub. Date: Mar. 11, 2010

(65) Prior Publication Data

US 2011/0158794 A1 Jun. 30, 2011

(30) Foreign Application Priority Data

Sep. 3, 2008 (DE) ..... 10 2008 045 669

(51) Int. Cl.
*F01D 25/24* (2006.01)

(52) U.S. Cl. ..... 415/215.1

(58) Field of Classification Search ..... 415/201, 415/203, 206, 214.1, 215.1, 138
See application file for complete search history.

(56) References Cited

U.S. PATENT DOCUMENTS

| | | | |
|---|---|---|---|
| 3,390,830 | A | 7/1968 | Kahane |
| 5,961,281 | A | 10/1999 | Ojima |

FOREIGN PATENT DOCUMENTS

| | | | |
|---|---|---|---|
| DE | 2542336 | A1 | 3/1977 |
| DE | 3835341 | A1 | 4/1990 |
| DE | 60223317 | T2 | 8/2008 |
| GB | 168772 | A | 9/1921 |
| SU | 732556 | A1 | 5/1980 |
| WO | WO 2005045251 | A1 | 5/2005 |

*Primary Examiner* — Edward Look
*Assistant Examiner* — Jesse Prager

(57) ABSTRACT

An intermediate housing floor for a fluid kinetic machine is provided. The intermediate housing floor includes a partial joint at which the intermediate housing floor may be divided during installation and/or removal into/from the fluid kinetic machine and is made up of at least two overlapping partial joint surfaces at sections of the intermediate housing floor that face one another. A recess is provided in the area of the overlap in at least the one partial joint surface, a coating is kept in the recess. The coating protrudes from the one partial joint surface as a protrusion in the removed state of the intermediate housing floor in which the intermediate housing floor is divided at the partial joint so that in the installed state of the intermediate housing floor the coating abuts against the other partial joint surface facing the one partial joint surface, whereupon the partial joint is sealed.

19 Claims, 4 Drawing Sheets

INTERMEDIATE HOUSING FLOOR FOR A FLUID KINETIC MACHINE

CROSS REFERENCE TO RELATED APPLICATIONS

This application is the U.S. National Stage of International Application No. PCT/EP2009/060922, filed Aug. 25, 2009 and claims the benefit thereof. The International Application claims the benefits of German application No. 10 2008 045 669.1 DE filed Sep. 3, 2008. All of the applications are incorporated by reference herein in their entirety.

FIELD OF INVENTION

The invention relates to an intermediate housing floor for a fluid kinetic machine, and to a fluid kinetic machine having the intermediate housing floor.

BACKGROUND OF INVENTION

A kinetic flow machine such as a radial turbocompressor is configured, for example, as a single shaft compressor which has a shaft, with running wheels threaded onto it, and a housing which surrounds the running wheels. The shaft is mounted radially and axially outside the housing by means of bearings, flow channels from and to the running wheels being formed in the interior of the housing by the provision of housing internals. The running wheels are configured, for example, as radial running wheels which have, for example, an axial inflow direction and a radial outflow direction. Flow passes through the running wheels one after another, with the result that process gas is compressed in stages from running wheel to running wheel. An annular diffuser is provided on the outflow side of each running wheel, through which annular diffuser the process gas is guided radially to the outside. The process gas is deflected with the aid of a deflection channel after the annular diffuser, and is guided radially to the inside again through a return channel to the next running wheel. In the housing, the housing internals are provided with a corresponding shape, with the result that the annular diffuser, the deflection channel and the return channel are formed by the interaction of the housing internals in the housing.

The housing internals are conventionally configured as intermediate housing floors. Each intermediate housing floor is formed by two halves, with the result that the intermediate housing floor can be divided horizontally. Thus, for example, an intermediate housing floor can be mounted by attaching one half into the lower part of the housing (horizontally divided fluid kinetic machine) or into the lower part of the inner housing (vertically divided fluid kinetic machine) and by fastening the other half into the upper part. The two halves form a part joint at their contact faces, which part joint can gape apart on account of production inaccuracies and/or a deformation of the halves caused by pressure loading during operation of the radial turbocompressor, and can therefore become gas-permeable. As a result, a leak is produced through the part joint, which leak is considerable, in particular, in the case of radial turbocompressors with high pressure differences. In particular, the leak is disadvantageous in the case of radial turbocompressors with a high pressure ratio and a small delivery volumetric flow. The degree of efficiency of the radial turbocompressor is reduced by the leak, as a result of which the required input power is increased if predefined boundary conditions are met by the radial turbocompressor. Furthermore, the maximum possible prediction accuracy with regard to pressure ratio and delivery volumetric flow of the radial turbocompressor is affected by relatively high tolerances, since the actual effect of the possibly gaping part joint on the operating parameters of the radial turbocompressor can be predicted only with difficulty.

Here, for example, the provision of an O-ring in the part joint could provide a remedy. However, there is the disadvantage here that the O-ring can be destroyed in the case of a relative movement of the halves of the intermediate housing floor. O-rings are likewise not suitable for all thermal and chemical loads. It would also be conceivable in the part joint to provide the halves of the intermediate housing floor with grooves, into which a feather key is arranged. The locating fits necessary for this purpose for inserting the feather key into the grooves cannot be maintained, or can only be maintained to a limited extent, in a manner conditional on manufacturing. As a result, clearances are set between the feather key and the grooves, which clearances form a connecting channel between the two sides of the intermediate housing floor, with the result that the leak through the part joint would be increased disadvantageously.

SUMMARY OF INVENTION

It is an object of the invention to provide an intermediate housing floor for a fluid kinetic machine and a fluid kinetic machine with the intermediate housing floor, the fluid kinetic machine having a high degree of efficiency.

According to the invention, the object is achieved by an intermediate housing floor of the type mentioned in the introduction, which intermediate housing floor has the additional features of the claims.

In the case of the first mounting of the intermediate housing floor in the fluid kinetic machine, the intermediate housing floor is provided with the part joint and the two part joint faces. The recess which is formed in the one part joint face is provided with the coating, the coating protruding from the one part joint face, with the result that the coating has the projection. When the intermediate housing floor is installed into the fluid kinetic machine, the two part joint faces are placed against one another, with the result that the coating bears against the other part joint face which faces it. As soon as the part joint faces are arranged in contact with one another, the coating is compressed at its projection. As a result, the coating bears sealingly and flatly against the part joint face which faces it, with the result that the part joint is sealed by the coating. Therefore, a leak of process gas through the part joint is suppressed or at least reduced during the operation of the fluid kinetic machine, as a result of which the fluid kinetic machine has an improved degree of efficiency.

Structural inaccuracies can occur in the fluid kinetic machine in a manner conditional on manufacturing, which structural inaccuracies lead in the assembled fluid kinetic machine to the part joint faces not bearing against one another completely. As a result, a gap is formed at the part joint, which gap leads to a leak of process gas during operation of the fluid kinetic machine. As a result of the fact that, in the dismantled state of the intermediate housing floor, the coating is provided with the projection, it is possible that, when the intermediate housing floor is mounted and the two part joint faces are arranged at a corresponding spacing conditional on manufacturing, the coating can bridge said spacing. As a result, the intermediate housing floor is sealed at the part joint by the coating in the mounted state, even in the case of great structural inaccuracies of the fluid kinetic machine, with the result that structural inaccuracies of this type cannot lead to an impairment of the performance parameters of the fluid kinetic machine. Moreover, the performance parameters of the fluid kinetic machine can be predicted with conventional methods in an improved manner, with the result that the fluid kinetic machine can be designed in a purposeful manner. As a result, the risk is reduced that, in the case of a possible trial run of the fluid kinetic machine, it is determined that the fluid kinetic machine cannot meet the required performance parameters. For this purpose, corresponding reworking actions would be necessary on the fluid kinetic machine, which actions can be omitted according to the invention.

The coating is preferably a honeycomb layer. The honeycomb layer can be produced inexpensively from correspondingly shaped sheet metal strips, with which a honeycomb structure of the honeycomb layer is formed. The honeycomb structure is configured in such a way that the sheet metal strips are compressed by the other part joint face in the mounted state of the intermediate housing floor. The honeycomb layer is preferably soldered into the recess.

As an alternative and/or in addition, the coating is preferably a flame-sprayed or plasma-sprayed coating. The sprayed coating preferably has an Ni—Al—Cr basis.

Furthermore, it is preferred that, in the region of the overlap, one recess is provided in the one part joint face and the other recess is provided in the other part joint face, in which recesses in each case one of the coatings is accommodated, the coatings being arranged so as to overlap one another.

It is preferred here that the coating of the one part joint face is the honeycomb layer and the coating of the other part joint face is the sprayed layer. In the dismantled state of the intermediate housing floor, the honeycomb layer with its projection is provided on the one part joint face and the sprayed layer is provided on the other part joint face. If the part joint faces are placed against one another during mounting, the honeycomb layer is pressed into the sprayed layer, possibly deforming itself, with the result that, with the sprayed layer, the honeycomb layer forms a dense structure in the part joint.

The thickness of the sprayed layer on the other part joint face is preferably dimensioned to be at least as great as the projection of the honeycomb layer, with the result that the honeycomb layer is pressed into the sprayed layer in the mounted state of the intermediate housing floor. As a result, in the mounted state of the intermediate housing floor, the sprayed layer extends only in the honeycomb interspaces of the honeycomb layer, since the honeycomb layer butts against the bottom of the recess of the other part joint face, with a certain spacing for manufacturing tolerances. As a result, the part joint is sealed in a stable and dense manner by way of the honeycomb layer and the sprayed layer. In an alternatively preferred manner, the projection is configured on the sprayed layer.

It is preferred that the intermediate housing floor is formed from a lower half and an upper half which, in the mounted state, form the part joint in a plane, in which the rotational axis of the fluid kinetic machine lies. As a result, the intermediate housing floor is formed from the approximately equally large halves, with the result that the intermediate housing floor can be mounted and dismantled simply. It is preferred that the one part joint face with the honeycomb layer is provided on the lower half, and the other part joint face with the sprayed layer is provided on the upper half. It is alternatively preferred that the one part joint face with the honeycomb layer is provided on the upper half, and the other part joint face with the sprayed layer is provided on the lower half.

It is preferred that the fluid kinetic machine is a radial turbocompressor which has a radial turbocompressor stage with an annular diffuser, a deflection channel and a return channel which are formed by at least two intermediate housing floors.

BRIEF DESCRIPTION OF THE DRAWINGS

In the following text, one preferred embodiment of the intermediate housing floor according to the invention and of the radial turbocompressor according to the invention will be explained using the appended diagrammatic drawings, in which.

DETAILED DESCRIPTION OF INVENTION

Figure 1:
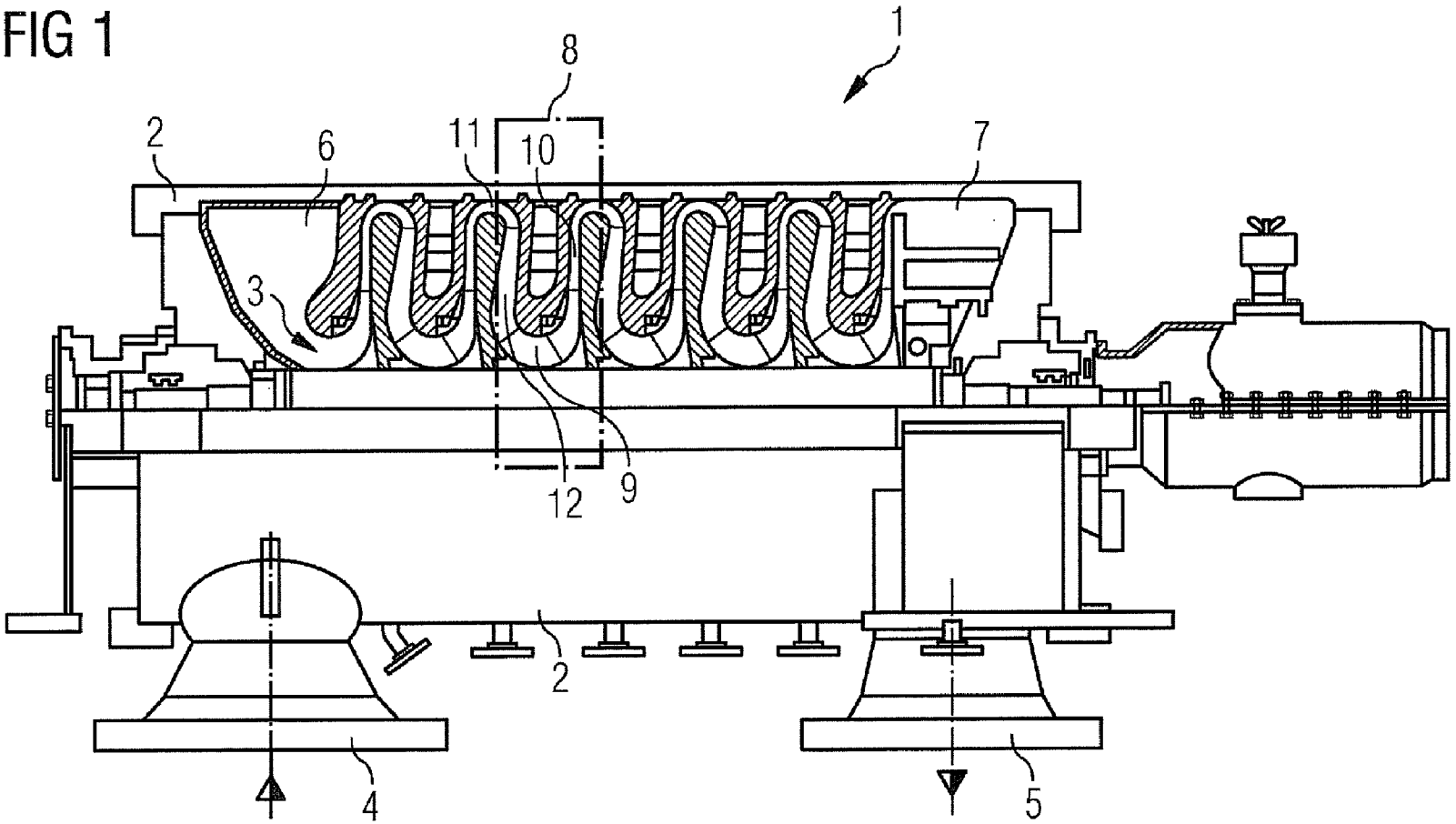
FIG. 1 shows a longitudinal section of a radial turbocompressor, split horizontally.
Figure 2:
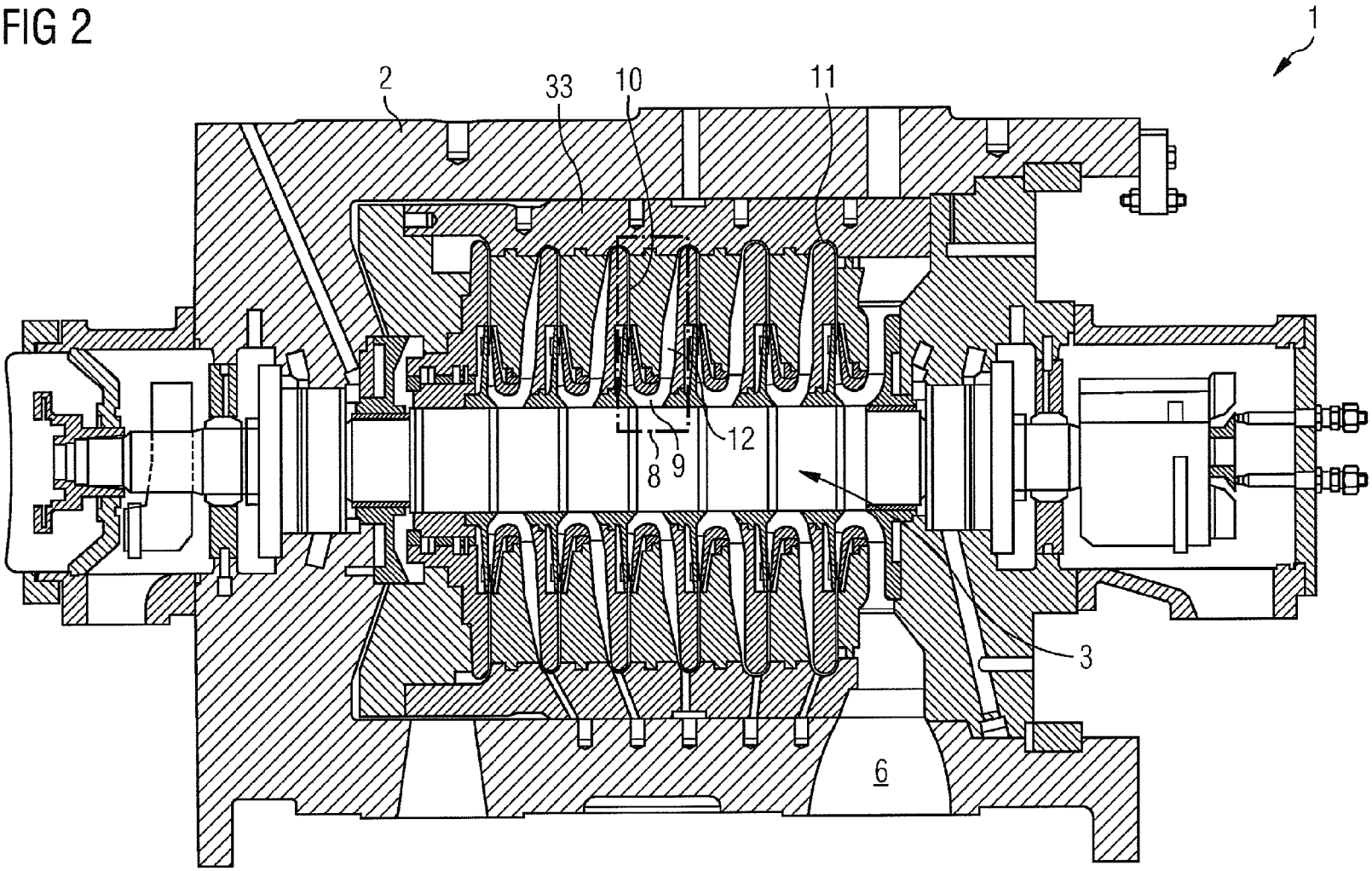
FIG. 2 shows a longitudinal section of a radial turbocompressor, split vertically.

As can be seen from FIGS. 1 and 2, a radial turbocompressor 1 has a housing 2, or a housing 2 and an inner housing 33 and a rotor 3. A suction connector 4 and a pressure connector 5 are provided on the housing 2, the suction connector 4 opening in the interior of the housing 2 into an inlet 6, and an outlet spiral 7 which is provided in the interior of the housing 2 opening into the pressure connector 5.

Six radial turbocompressor stages 8 are formed in the radial turbocompressor 1 according to FIGS. 1 and 2, which radial turbocompressor stages 8 are formed in each case by a running wheel 9 of the rotor 3. Each running wheel 9 has an axial inflow direction which points in the direction of the rotational axis 24 of the rotor 3 and an outflow direction which points radially to the outside. An annular diffuser 10 which extends radially to the outside within the housing 2 and adjoins the running wheel 9 downstream of the latter is arranged in each radial turbocompressor stage 8. The annular diffuser 10 is followed in the flow direction by a deflection channel 11, in which process gas is deflected from the annular diffuser 10 into a return channel 12, in which the process gas flows radially to the inside to the running wheel 9 of the next radial turbocompressor stage 8.

A first intermediate housing floor 13 and a second intermediate housing floor 14 are provided for the radial turbocompressor stage 8 in the housing 2, which intermediate housing floors 13, 14 are provided with a contour of this type and are arranged with respect to one another in such a way that the annular diffuser 10, the deflection channel 11 and the return channel 12 are formed in the housing 2 with the interaction of the first intermediate housing floor 13 and the second intermediate housing floor 14.

The first intermediate housing floor 13 has a cylindrical outer side 15 and bears against the inner side of the housing 2, the first intermediate housing floor 13 being locked on the housing 2 by way of an annular web 16. The first intermediate housing floor 13 and the second intermediate housing floor 14 are similar in terms of their construction, with the result that reference is made in the following text merely to the first intermediate housing floor 13. The first intermediate housing floor 13 has a lower half 17 and an upper half 18, with the result that a part joint 19 is formed by the lower half 17 and the upper half 18. The lower half 17 and the upper half 18 are of substantially geometrically identical configuration, with the result that the part joint 19 lies in a plane, in which the rotational axis 24 of the radial turbocompressor 11 is situated. The lower half 17 has a part joint face 20 and the upper half 18 has a part joint face 21, the part joint faces 20, 21 being configured identically in terms of their outline, with the result that, when the lower half 17 is placed against the upper half 18 with the formation of the part joint 19, the part joint faces 20 and 21 overlap one another completely.

Figure 3:
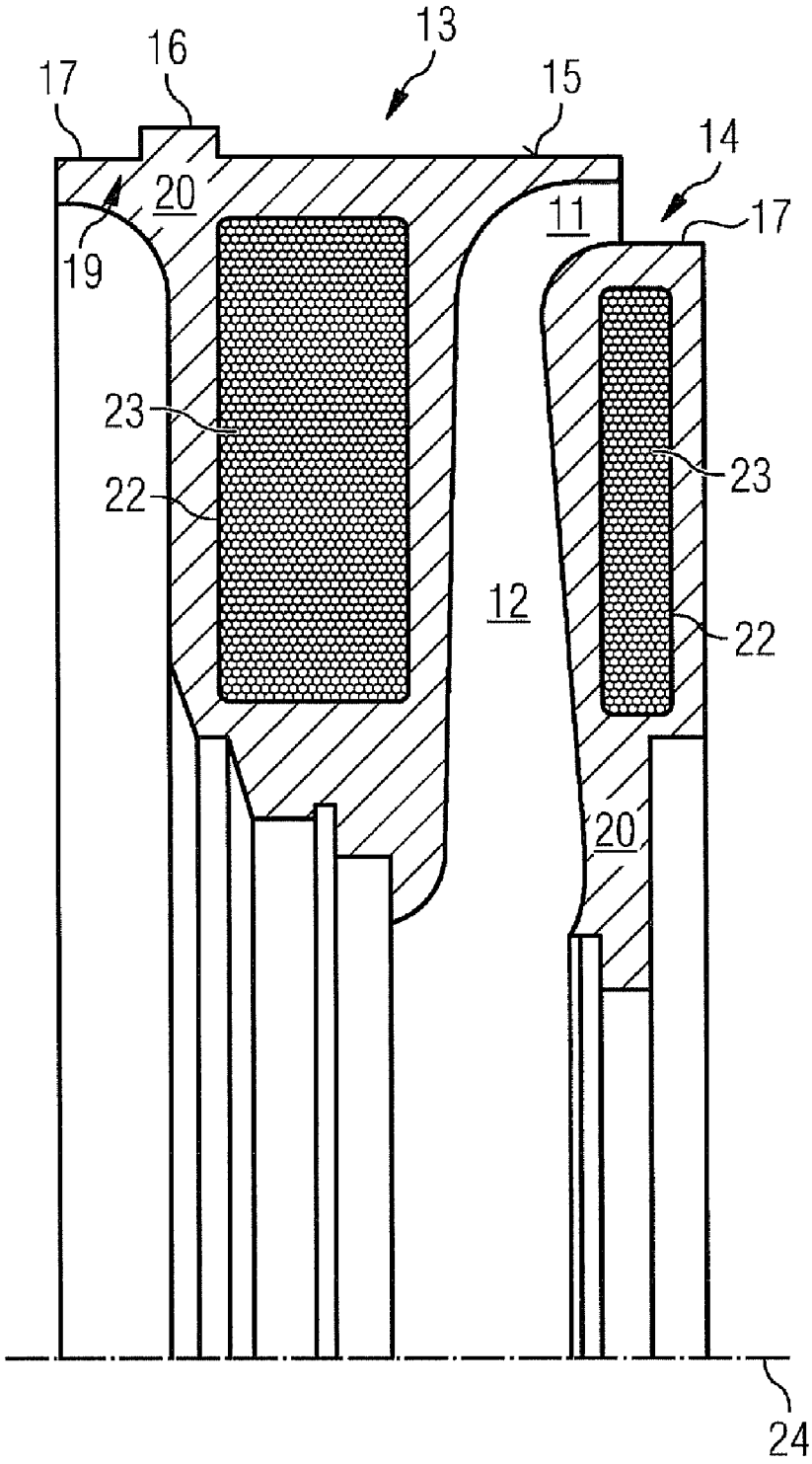
FIG. 3 shows a part joint of intermediate housing floors.
Figure 6:
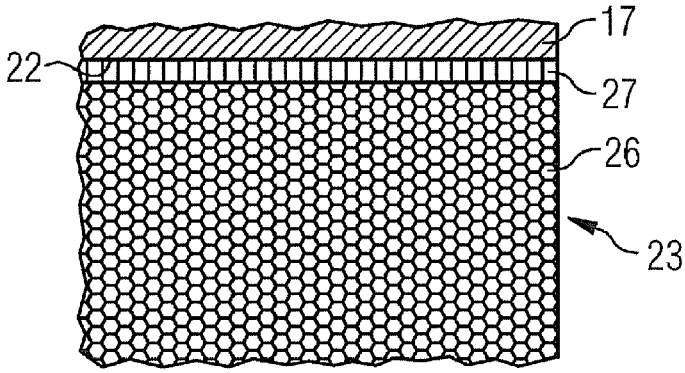
FIGS. 6 and 7 show details of the plan view of the part joint of the intermediate housing floor.
Figure 7:
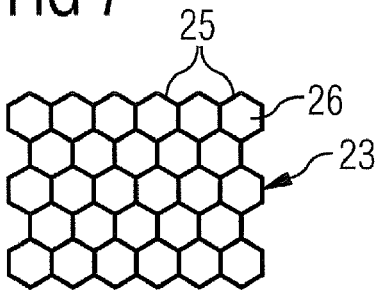

FIG. 3 shows a plan view of the part joint face 20 of the lower half 17. A recess 22 is provided in the inner region of the part joint face 20, the edge of which recess 22 is always arranged at a spacing from the edge of the part joint face 20. The recess 22 is thus surrounded completely by the part joint face 20. A honeycomb layer 23 which fills the recess 22 completely is accommodated in the recess 22. As is shown in FIGS. 6 and 7, the honeycomb layer 23 is constructed from sheet metal strips 25 which are of undulating shape and are joined together with the formation of honeycombs. A soldering metal 27 is provided at the edge of the recess 22, by way of which soldering metal 27 the honeycomb layer 23 is fastened in the recess 22.

Figure 4:
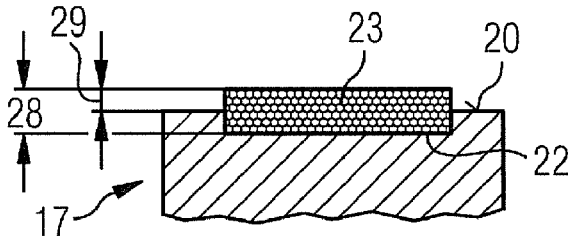
FIGS. 4 and 5 show a detailed cross section of the part joint of the intermediate housing floor.
Figure 5:
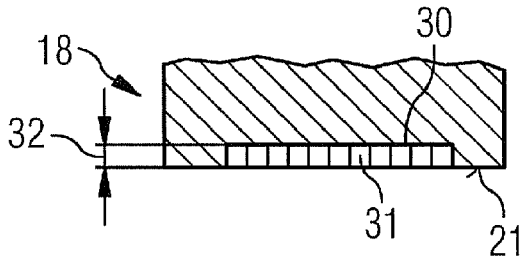

As is shown in FIG. 4, the honeycomb layer 23 has a web height 28 which is greater than the depth of the recess 22. This results in a projection 29 on the honeycomb layer 23, which projection 29 protrudes from the part joint face 20. That part joint face 21 of the upper half 18 which faces the part joint face 20 of the lower half 17 in the mounted state of the intermediate housing floor 13 has a recess 30, the edge of which extends parallel to the edge of the recess 22. By trend, the recess 30 is configured to be greater in its extent along the part joint face 21 than the recess 22, with the result that the recess 30 covers the recess 22 completely. As a result, it is prevented that the honeycomb layer 23 which is arranged in the recess 22 comes into contact with the edge of the recess 30 and the part joint face 20.

A sprayed layer 31 which fills the recess 30 completely is provided in the recess 30. The depth of the recess 30 results in a layer thickness 32 which, dependent on manufacturing, is configured either to be equal to the projection 29 or greater.

During mounting of the intermediate housing floor 13, the upper half 18 is placed with its part joint face 21 onto the part joint face 20 of the lower half 17, the recesses 22 and 30 coming into congruence. On account of the projection 29 of the honeycomb layer 23 which is provided on the recess 22, said honeycomb layer 23 is inserted into the sprayed layer 31. As a result, a dense and stable configuration is provided in the part joint 19 by way of the honeycomb layer 23 and the sprayed layer 31.

The invention claimed is:

1. An intermediate housing floor for a fluid kinetic machine, comprising:

a part joint, comprising:

at least two part joint faces; and a first recess and a second recess, wherein at the part joint the intermediate housing floor may be divided during a mounting into and/or dismantling from the fluid kinetic machine, wherein and the at least two part joint faces overlap one another on mutually facing sections of the intermediate housing floor, wherein the first recess is provided in a region of the overlap in a first part joint face, in which first recess a first coating is accommodated which protrudes from the first part joint face as a projection in the dismantled state of the intermediate housing floor, wherein in the dismantled state the intermediate housing floor is divided at the first part joint, with the result that, in the mounted state of the intermediate housing floor, the first coating bears against a second part joint face which faces the first part joint face, as a result of which the part joint is sealed, and wherein the first recess is provided in the first part joint face in the region of the overlap and the second recess is provided in the second part joint face, in which a second coating is accommodated, the coatings being arranged so as to overlap one another.

2. The intermediate housing floor as claimed in claim 1, wherein the first coating is embodied as a honeycomb layer.

3. The intermediate housing floor as claimed in claim 2, wherein the honeycomb layer is soldered into the first recess.

4. The intermediate housing floor as claimed in claim 1, wherein the second coating is a flame-sprayed or plasma-sprayed layer.

5. The intermediate housing floor as claimed in claim 4, wherein the sprayed layer comprises a Ni—Al—Cr base.

6. The intermediate housing floor as claimed in claim 1, wherein the first coating of the first part joint face is a honeycomb layer and the second coating of the second part joint face is a sprayed layer.

7. The intermediate housing floor as claimed in claim 6, wherein the layer thickness of the sprayed layer of the second part joint face is dimensioned to be at least as large as the projection of the honeycomb layer, with the result that the honeycomb layer is pressed into the sprayed layer in the mounted state of the intermediate housing floor.

8. The intermediate housing floor as claimed in claim 1, wherein the intermediate housing floor is formed from a lower half and an upper half which, in the mounted state, form the part joint in a plane, in which a rotational axis of the fluid kinetic machine lies.

9. The intermediate housing floor as claimed in claim 8, wherein the first part joint face with the honeycomb layer is provided on the lower half, and wherein the second part joint face with the sprayed layer is provided on the upper half.

10. A fluid kinetic machine, comprising:

an intermediate housing floor, comprising:

a part joint, comprising:

at least two part joint faces; and a first recess and a second recess, wherein at the part joint the intermediate housing floor may be divided during a mounting into and/or dismantling from the fluid kinetic machine, wherein and the at least two part joint faces overlap one another on mutually facing sections of the intermediate housing floor, wherein the first recess is provided in a region of the overlap in a first part joint face, in which recess a first coating is accommodated which protrudes from the first part joint face as a projection in the dismantled state of the intermediate housing floor, wherein in the dismantled state the intermediate housing floor is divided at the first part joint, with the result that, in the mounted state of the intermediate housing floor, the first coating bears against a second part joint face which faces the first part joint face, as a result of which the part joint is sealed, and wherein the first recess is provided in the first part joint face in the region of the overlap and the second recess is provided in the second part joint face, in which a second coating is accommodated, the coatings being arranged so as to overlap one another.

11. The fluid kinetic machine as claimed in claim 10, wherein the fluid kinetic machine is a radial turbocompressor which includes a radial turbocompressor stage, and wherein the radial turbocompressor stage includes an annular diffuser, a deflection channel and a return channel which are formed by at least two intermediate housing floors.

12. The fluid kinetic machine as claimed in claim 10, wherein the first coating is embodied as a honeycomb layer.

13. The fluid kinetic machine as claimed in claim 12, wherein the honeycomb layer is soldered into the first recess.

14. The fluid kinetic machine as claimed in claim 10, wherein the second coating is a flame-sprayed or plasma-sprayed layer.

15. The fluid kinetic machine as claimed in claim 14, wherein the sprayed layer comprises a Ni—Al—Cr base.

16. The fluid kinetic machine as claimed in claim 10, wherein the first coating of the first part joint face is a honeycomb layer and the second coating of the second part joint face is a sprayed layer.

17. The fluid kinetic machine as claimed in claim 16, wherein the layer thickness of the sprayed layer of the second part joint face is dimensioned to be at least as large as the projection of the honeycomb layer, with the result that the honeycomb layer is pressed into the sprayed layer in the mounted state of the intermediate housing floor.

18. The fluid kinetic machine as claimed in claim 10, wherein the intermediate housing floor is formed from a lower half and an upper half which, in the mounted state, form the part joint in a plane, in which a rotational axis of the fluid kinetic machine lies.

19. The fluid kinetic machine as claimed in claim 18, wherein the first part joint face with the honeycomb layer is provided on the lower half, and wherein the second part joint face with the sprayed layer is provided on the upper half.

* * * * *